US008342360B2

(12) United States Patent
Long

(10) Patent No.: US 8,342,360 B2
(45) Date of Patent: Jan. 1, 2013

(54) STACK OF INTERFOLDED SHEETS

(76) Inventor: Leslie Thomas Long, Appleton, WI (US)

( * ) Notice: Subject to any disclaimer, the term of this patent is extended or adjusted under 35 U.S.C. 154(b) by 1982 days.

(21) Appl. No.: 11/112,430

(22) Filed: Apr. 22, 2005

(65) Prior Publication Data

US 2006/0237474 A1 Oct. 26, 2006

(51) Int. Cl.
*A47K 10/24* (2006.01)
*B65H 1/00* (2006.01)

(52) U.S. Cl. ..... 221/48; 221/33; 221/49; 221/50; 221/38; 221/46; 221/34; 221/63; 221/35; 221/56; 206/494; 206/209; 206/812; 206/233; 493/405; 493/415; 493/436; 428/126; 428/130; 428/402

(58) Field of Classification Search ..... 221/33, 221/48, 49, 50, 38, 46, 34, 63, 35, 56; 206/494, 206/209, 812, 233; 428/126, 130, 402; 493/405, 493/416, 436
See application file for complete search history.

(56) References Cited

U.S. PATENT DOCUMENTS

| | | | | |
|---|---|---|---|---|
| 2,611,482 | A * | 9/1952 | Nelson | 221/51 |
| 4,181,225 | A * | 1/1980 | Spiegelberg | 206/494 |
| 4,197,964 | A * | 4/1980 | Pryor | 221/50 |
| 4,469,243 | A * | 9/1984 | Ito et al. | 221/34 |
| 5,215,757 | A | 6/1993 | El-Nokaly | |
| 5,599,555 | A | 2/1997 | El-Nokaly | |
| 5,980,931 | A | 11/1999 | Fowler et al. | |
| 6,045,002 | A * | 4/2000 | Wierschke | 221/48 |
| 6,121,165 | A | 9/2000 | Mackey et al. | |
| 6,168,848 | B1 * | 1/2001 | Heath | 428/126 |
| 6,196,390 | B1 * | 3/2001 | Bando | 206/494 |
| 6,202,845 | B1 * | 3/2001 | Hill | 206/449 |
| 6,213,344 | B1 * | 4/2001 | Hill | 221/38 |
| 6,213,345 | B1 * | 4/2001 | Plank | 221/46 |
| 6,238,328 | B1 | 5/2001 | Loppnow et al. | |
| 6,250,495 | B1 * | 6/2001 | Bando | 221/48 |
| 6,286,712 | B1 * | 9/2001 | Craig et al. | 221/48 |
| 6,550,634 | B1 * | 4/2003 | Alegre De Miquel et al. | 221/48 |
| 6,595,386 | B2 * | 7/2003 | Vogel et al. | 221/48 |
| 6,599,228 | B2 * | 7/2003 | Hailey et al. | 493/405 |
| 6,602,575 | B2 * | 8/2003 | Lefevre Du Grosriez et al. | 428/124 |
| 6,627,033 | B1 * | 9/2003 | Dexter | 156/260 |
| 6,685,050 | B2 * | 2/2004 | Schmidt et al. | 221/48 |
| 6,960,349 | B2 * | 11/2005 | Shantz et al. | 424/402 |
| 6,964,349 | B2 * | 11/2005 | Sears et al. | 221/48 |

(Continued)

FOREIGN PATENT DOCUMENTS

EP 1 293 156 A1 3/2003

(Continued)

*Primary Examiner* — Gene Crawford
*Assistant Examiner* — Rakesh Kumar
(74) *Attorney, Agent, or Firm* — Michael J. Sullivan

(57) ABSTRACT

A product including a stack of a: plurality of interfolded sheets assembled from a folded sheet material. The stack having a first side, a second side, a plurality of first side folded sheets and a plurality of second side folded sheets. A majority of the first side folded sheets folded into a first fold configuration and a majority of the second side folded sheets folded into a second fold configuration. Within the stack, the first fold configuration is different than the second fold configuration. In one embodiment, the first side folded sheets were V-folded and the second side folded sheets were Z-folded. In another embodiment, the first side folded sheets were V-folded and the second side folded sheets were C-folded.

10 Claims, 4 Drawing Sheets

U.S. PATENT DOCUMENTS

| | | | | |
|---|---|---|---|---|
| 2002/0060222 | A1* | 5/2002 | Bando | 221/48 |
| 2002/0070141 | A1* | 6/2002 | Iida | 206/494 |
| 2004/0115393 | A1* | 6/2004 | Vogel et al. | 428/121 |
| 2006/0102644 | A1 | 5/2006 | Long et al. | |
| 2006/0131319 | A1 | 6/2006 | McDonald | |
| 2007/0034534 | A1* | 2/2007 | VanBuren | 206/233 |
| 2007/0062968 | A1* | 3/2007 | Mark et al. | 221/48 |
| 2010/0059538 | A1* | 3/2010 | Van De Perre | 221/34 |
| 2010/0104799 | A1* | 4/2010 | Wunderlich | 428/130 |
| 2012/0165174 | A1* | 6/2012 | Butterworth | 493/451 |

FOREIGN PATENT DOCUMENTS

| | | | |
|---|---|---|---|
| WO | WO 02/064435 | A2 | 8/2002 |

* cited by examiner

STACK OF INTERFOLDED SHEETS

BACKGROUND

Sheet materials such as sheets of tissue, towel, wet wipes, non-woven, air laid, meltblown, or spun-laced materials are frequently folded and superposed to form a stack which may be stored in a container or dispenser. Typically, all the sheets are equal in size when unfolded. It is desirable to interfold or interleave the sheets of the stack such that removing the first sheet from the container causes the next sheet to "pop-up" or move into position for removal. It is also desirable that the sheet folding configuration is stackable with a uniform height across its top surface. Therefore, it is desirable that any vertical cross section through the stack has substantially the same number of layers of sheet material.

A stack of sheet material is disclosed in U.S. Pat. No. 2,611,482, entitled Dispensing Package for Interfolded Sheet Material that issued Sep. 16, 1950, to Nelson. The stack is folded about a transverse fold axis and disposed into a container such that the stack or clip is dispensed from the side through the dispenser's opening as seen in FIG. 5. This arrangement of the sheet material in the stack allows for the use of a dispensing package having a relatively small base area, which reduces the foot print of the dispenser.

As discussed in the '482 patent: "From an inspection of FIGS. 6, 7 and 8 and the foregoing explanation, it will be seen that alternate withdrawals from the interfolded stack will start with a projecting sheet portion or leader as represented in FIG. 6 and that the intermediate withdrawals will be of a relatively loosely or freely supported sheet as represented by the sheet A in FIG. 8.

The described arrangement for withdrawing sheets is particularly adapted to the dispensing of fairly rough surfaced sheets which have a considerable amount of face-to-face frictional engagement with one another. Smoother sheets, such as typified by the better grades of soft, smooth facial tissues will be less effectively dispensed by the described arrangement owing to the relatively small amount of friction existing between the sheets, especially when the amount of material left in a package becomes small so that compression of the sheets within the package is greatly reduced." Consequently, in the '482 patent, every other sheet withdrawal requires a higher level of pulling force and distance as compared to the intermediate sheet withdrawals of the loose or freely supported sheets. Additionally, the amount of the sheet material extending out of the dispensing package also varies between the sheets as they are dispensed.

An ongoing desire in the packaging of sheet materials is to offer alternative packaging formats and to offer these formats on smoother sheet materials such as facial tissue. Therefore, what is needed is an improved stack of interfolded sheet materials specifically configured for side dispensing that improves sheet dispensing by eliminating intermediate withdrawals of a relatively loose or a freely supported sheet, and/or that reduces the pulling force variation, and/or that provides for a consistent amount of sheet material extending out of the dispenser. Also, what is needed is an interfolded stack that effectively dispenses any type of sheet material, wet or dry, including lower coefficient of friction or smoother sheet materials.

SUMMARY

The inventors have determined that the above needs can be met by an interfolded stack having the majority of the even-numbered sheets folded in a first fold configuration and the majority of the odd-numbered, or alternating, sheets folded into a second fold configuration. In one embodiment, the even-numbered sheets were V-folded and the odd-numbered, or alternating, sheets were Z-folded. In another embodiment, the even-numbered sheets were V-folded and the odd-numbered, or alternating, sheets were C-folded.

Hence in one embodiment, the invention resides in a product including: a stack of a plurality of interfolded sheets assembled from a folded sheet material; the stack having a first side, a second side, a plurality of first side folded sheets and a plurality of second side folded sheets; a majority of the first side folded sheets folded into a first fold configuration; a majority of the second side folded sheets folded into a second fold configuration; and wherein the first fold configuration is different than the second fold configuration.

BRIEF DESCRIPTION OF THE DRAWINGS

The above aspects and other features, aspects, and advantages of the present invention will become better understood with regard to the following description, appended claims, and accompanying drawings in which:

Figure 1:
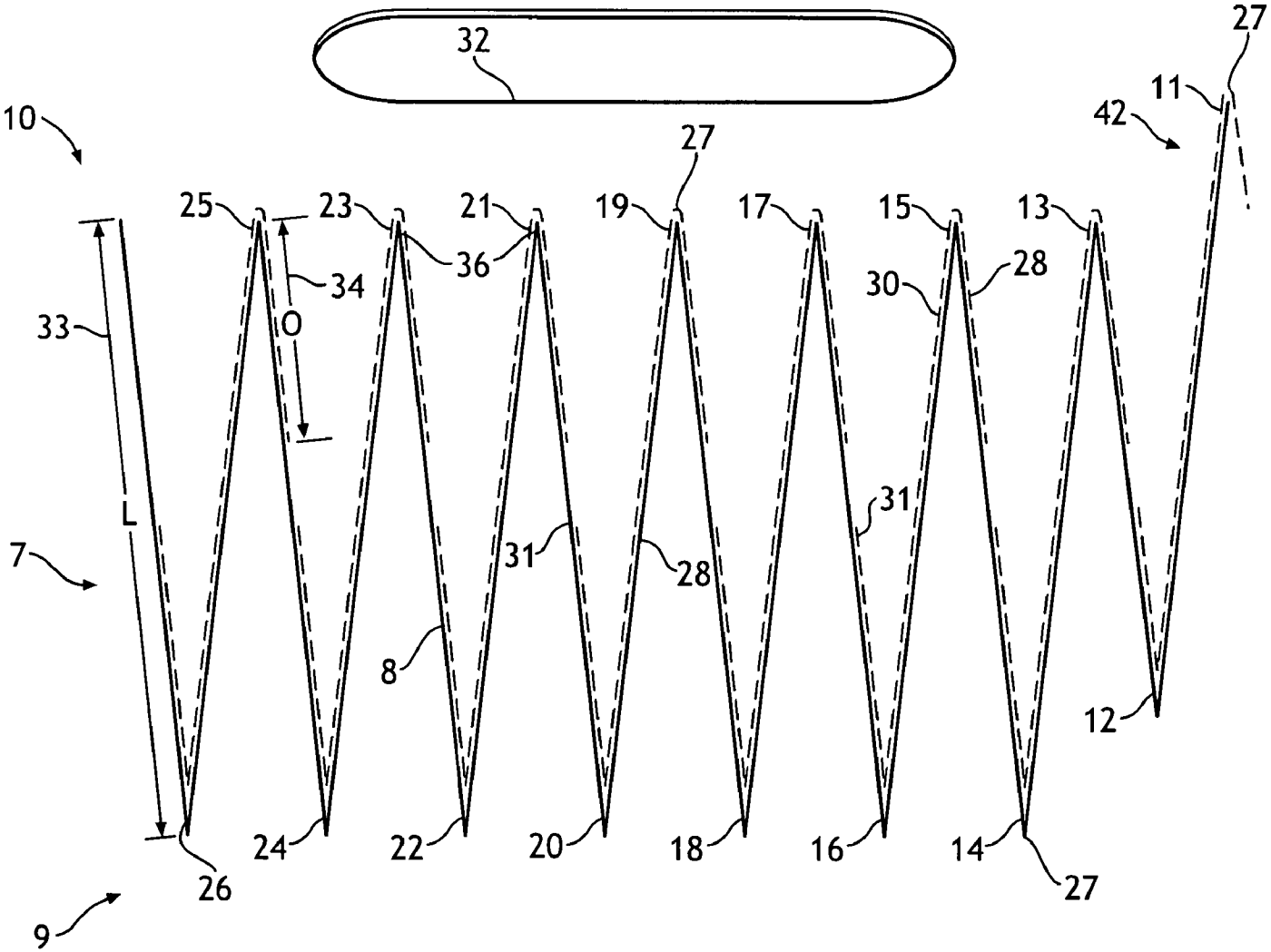
FIG. 1 illustrates one embodiment of a stack of interfolded sheet material.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps, or limitations may be present in addition to the recited elements, functions, steps, or limitations.

As used herein, "sheet material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; single or multi-ply paper substrates comprising cellulose such as tissue paper, toilet paper, facial tissue, or paper towels; waxed paper substrates; coform substrates comprising cellulose fibers and polymer fibers; wet substrates such as wet wipes, moist cleaning wipes, moist toilet paper, and baby wipes; film or plastic substrates such as those used to wrap food; and shop towels. Furthermore, laminated or plied together substrates of two or more layers of any of the preceding substrates are also suitable.

As used herein, "wet sheet material" includes substrates that are either wet or pre-moistened by an appropriate liquid, partially moistened by an appropriate liquid, or containing encapsulated liquids. Wet sheet materials generally have a moisture content of greater than about 10% by weight of the dry substrate. Suitable wet sheet materials can have encapsulated ingredients such that the capsules rupture during dispensing or use. Examples of encapsulated materials include those disclosed in U.S. Pat. No. 5,215,757, entitled Encapsulated Materials and issued to El-Nokaly on Jun. 1, 1993, and U.S. Pat. No. 5,599,555, entitled Encapsulated Cosmetic Compositions and issued to El-Nokaly on Feb. 4, 1997. Other suitable wet sheet materials include dry substrates that deliver liquid when subjected to in-use shear and compressive forces. Such substrates are disclosed in U.S. Pat. No. 6,121,165, entitled Wet-Like Cleaning Articles and issued to Mackay et al. on Sep. 19, 2000.

As used herein, "substantially dry sheet material" includes substrates that are initially dry (less than about 10% by weight of the substrate water or liquid) but intended to be moistened prior to use by placing the substrate into an appropriate liquid such as water or a solvent. Non-limiting examples of substantially dry substrates include substrates containing lathering surfactants and conditioning agents either impregnated into or applied to the substrate such that wetting of the substrate with water prior to use yields a personal cleansing product. Such substrates are disclosed in U.S. Pat. No. 5,980,931, entitled Cleansing Products Having A Substantially Dry Substrate and issued to Fowler et al. on Nov. 9, 1999.

DETAILED DESCRIPTION

It is to be understood by one of ordinary skill in the art that the present discussion is a description of exemplary embodiments only and is not intended as limiting the broader aspects of the present, invention, which broader aspects are embodied in the exemplary construction.

Referring to FIG. 1, an interfolded stack 7 of sheet material 8 having a plurality of individual interfolded sheets (11-26) is illustrated. The interfolded stack 7 has a first or bottom side 9 and a second or top side 10. The majority of the first side, even numbered sheets 14-26 (bottom-hand sheets), are folded into a first fold configuration, and the majority of the second side, odd number sheets 13-25 (top-hand sheets), are folded into a second fold configuration. In the illustrated embodiment, the bottom-hand sheets are folded into a V-fold and interfolded with the top-hand sheets folded into a Z-fold.

If desired, the top-hand sheets could be V-folded and interfolded with the bottom-hand sheets that are Z-folded, depending on the dispenser opening configuration. For the purposes of this invention, a bottom-hand sheet or a first side folded sheet is a sheet that has a visible fold 27 when viewing the stack from the first, or bottom, side 9. A top-hand sheet, or second side folded sheet, is a sheet that has a visible fold 27 when viewing the stack from the second, or top, side 10.

While it is not required that all of the bottom-hand or all of the top-hand sheets be folded exactly the same, at least the majority (greater than ½ of the sheets for each hand) of the bottom-hand and of the top-hand sheets should be folded the same way. Additionally, the majority of the bottom-hand sheets should be folded in a different manner than the majority of the top-hand sheets. For example, the bottom-hand sheets can be V-folded and the top-hand sheets Z-folded. Or, the bottom-hand sheets could be V-folded and the top-hand sheets C-folded. Thus, while the individual sheets or even significant portions of the stack 7 may be folded differently for improved dispensing of the initial sheets, or to create a starter sheet(s), or for another purpose, the majority of the sheets in the stack are folded in two different folded configurations depending on which side of the stack the folded sheet is located. In FIG. 1, sheets 11 and 12 can be folded differently to create two starter sheets for dispensing as discussed herein later.

In various embodiments of the invention, greater than about 70 percent of the bottom-hand sheets are folded into a first fold configuration and greater than about 70 percent of the top-hand sheets are folded into a second fold configuration, or greater than about 80 percent of the bottom-hand sheets are folded into a first fold configuration and greater than about 80 percent of the top-hand sheets are folded into a second fold configuration, or greater than about 90 percent of the bottom-hand sheets are folded into a first fold configuration and greater than about 90 percent of the top-hand sheets are folded into a second fold configuration, or greater than about 95 percent of the bottom-hand sheets are folded into a first fold configuration and greater than about 95 percent of the top-hand sheets are folded into a second fold configuration. It is not necessary for the first and second fold configurations to be completely different fold types, only that the folded configurations are different.

The Z-folded sheets have a leading panel 28, a center panel 30, and a trailing panel 31, each separated by a fold 27. A "leading panel," as used herein, is the panel of the folded sheet that is first withdrawn through a dispensing opening 32 in a dispenser 40. All or a portion of the leading panel desirably remains partially exposed extending from the dispenser's opening upon withdrawal of a sheet from the dispenser. Similarly, the V-folded sheets have a leading panel 28 and a trailing panel 31.

The V-folded sheets and the Z-folded sheets can have at least one folded panel length L (33) that is usually, but not necessarily, approximately ½ the length of the unfolded sheet. The V-folded sheets, however, do not need to be folded with a leading panel 28 and a trailing panel 31 having approximately the same length. For example, sheet 12 has a longer leading panel 28 than trailing panel 31. Similarly, the Z-folded sheets do not need to be folded with a leading panel 28 and a trailing panel 31 having approximately the same length. Desirably, the length of the Z-folded center panel 30 is approximately equal to at least one of the panel lengths of the V-folded sheets (28, 31). However, if stack uniformity is less important, the center panel length 32 of the Z-folded sheets can be different than either panel length of the V-folded sheets. In one embodiment, the majority of the Z-folded sheets have a center panel (30) length that is approximately equal to the majority of both of the V-folded panel lengths (28, 31) and the majority of the Z-folded sheet's leading and trailing panels (28, 31) lengths are approximately equal to ¼ the length of the unfolded sheet, as seen in FIG. 1.

The Z-folded sheets have an overlap length O (34) representing the length that the leading panel 28 is in interleaved contact with a preceding V-folded sheet by being folded over the trailing panel 31 of that sheet. The overlap length O can be altered to change the pop-up dispensing characteristics of the stack 7. Smoother sheet materials having a lower coefficient of friction may require less overlap length O, while rougher or textured sheet materials having a higher coefficient of friction may require more overlap length O. By having less overlap length O, a shorter length of the Z-folded sheet projects from the dispensing opening, thereby leaving more of the sheet within the dispenser and in sheet-to-sheet frictional contact with the next V-folded sheet. This can help to better dispense the next sheet for smoother sheet materials. Similarly, by having a longer overlap length O, more of the Z-folded sheet will project from the dispensing opening after withdrawing a V-folded sheet, leaving less of the Z-folded sheet within the dispenser and in sheet-to-sheet frictional contact with the next V-folded sheet. This can be useful when dispensing sheet materials having a higher coefficient of friction.

The overlap length O can be altered as a function of the position of the individual sheet within the stack. Thus, sheets located at a greater distance from the dispensing opening may require a longer overlap length O to pop-up reliably into the dispensing opening. This can be especially useful if the stack 7 is rotated 90 degrees and placed into a dispenser with the center panel 30 of the Z-folded sheets parallel to the dispenser's top panel having a dispensing opening.

Thus, depending on the overlap length O selected, the Z-folded sheets may not be folded perfectly symmetrical with a leading panel 28 and a trailing panel 31 having the same length. One panel may be longer, such as the leading panel 28 having the overlap length O folded around the trailing panel 31 of the preceding V-folded sheet. Alternatively, for low coefficient of friction sheet materials, the leading panel 28 may be shorter than the trailing panel 31 to leave less sheet material extending from the dispensing opening, thereby increasing sheet-to-sheet frictional contact. In various embodiments of the invention, an Overlap Ratio representing the overlap length O (34) divided by the panel length L (33) of the preceding sheet can be between about 0.2 to about 0.8, or between 0.3 to about 0.7, or between about 0.3 to about 0.6. In one embodiment, the Overlap Ratio was approximately 0.5.

The interfolded stack 7 of the present invention has an improved dispensing function over the interfolded stacks illustrated and described in U.S. Pat. No. 2,611,482. In particular, if the interfolded stack 7 is disposed into a dispenser 40 such that a dispensing opening 32 is located opposite the folds 27 in the V-folded sheets (12-26) significantly improved dispensing is obtained. Intermediate withdrawals of relatively loose or freely supported sheets can be avoided and the amount of sheet material extending from the dispensing opening can be approximately equal for each successive sheet that is withdrawn.

While not wishing to be bound by theory, the improved dispensing is believed to result from the two alternating folded configurations of the sheets within the stack 7 and from the orientation of the stack within the dispenser 40. Sheets 11 and 12 can be folded differently and extended as shown to form two starter sheets 42 that are removed together by pinching and pulling on the exposed folded portion of sheet 11, thereby trapping the leading panel 28 of sheet 12 and removing both together. As sheet 12 is removed, the leading panel 28 of sheet 13 is unfolded and exposed, leaving the leading panel of the sheet exposed from the dispensing opening 32. With the Z-folded sheet 13 partially extended through the dispenser's opening 32, most of the center panel 30 is adjacent to the leading panel 28 of the next V-folded sheet 14 and the trailing panel 31 is adjacent the trailing panel 31 of sheet 14. This increases the sheet-to-sheet contact area and may be desirable for low coefficient of friction sheet materials. As the Z-folded sheet is dispensed by pulling on the leading panel 28, its center panel 30 tends to curl as it is withdrawn out of the smaller dispensing opening 32. This action curls the leading panel 28 of the V-folded sheet 14, which pulls the leading panel of the V-folded sheet through the dispensing opening 32. As more and more of the Z-folded sheet 13 is pulled out of the opening, the contact surface area between the sheets decreases and the V-folded sheet 14 stops movement out of the dispensing opening, leaving the leading panel 28 partially exposed from the dispenser's opening.

When V-folded sheet 14 is next dispensed by pulling on the exposed leading panel 28, the trailing panel 31 unfolds the next leading panel 28 of the Z-folded sheet 15, leaving it exposed from the dispensing opening. Since the overlap length O is fairly short, there is little additional movement of Z-folded sheet 15 out of the dispenser's opening due to sheet-to-sheet friction. However, if sheet 15 were a V-folded sheet having two equal panel lengths instead of the illustrated Z-folded sheet, the amount of sheet material extending from the dispensing opening would likely be too great. This occurs since the length of approximately one full width panel L would be exposed and unfolded due to the large overlap length, plus any additional sheet-to-sheet friction would likely expose even more of the sheet. This can cause more of the sheet's length being exposed from the dispenser than being retained inside. In such circumstances, you end up with a free or loosely supported sheet in the dispensing opening.

The current invention solves this problem since, with the next sheet being Z-folded, the amount of sheet material extending from the dispensing opening is reduced to approximately the overlap length O. However, if the entire stack 7 was uniformly Z-folded throughout (same overlap length O) and interleaved, it is likely that every other sheet would not pop-up when dispensed from the second side 10 of the stack rather than one of the ends, as is more commonly done since there may be an insufficient overlap length O to reliably pop-up the bottom-hand Z-folded sheets. Thus, alternating V and Z folds leverages the overlap length O and the sheet-to sheet friction needed to ensure reliable dispensing for each folded sheet configuration while dispensing from the side of the stack rather than the end.

The overlap length O and/or the fold configuration can be readily adjusted to take into account the friction characteristics of the sheet material, the dispenser's design, and the dispensing opening's geometry and orientation to provide reliable dispensing. Furthermore, since the free ends 36 of each V-folded sheet are located approximately the same distance from the dispensing opening 32 regardless of the sheet's position within the stack, reliable dispensing from the first sheet to the last can be easily obtained with the same overlap distance O. Should an individual sheet fail to pop-up, most likely a V-folded sheet will not partially withdraw when pulling on a preceding Z-folded sheet, but the next V-folded sheet can be easily restarted since the free ends 36 of the sheet are located near the dispensing opening 32 and do not fall all the way down to the bottom of the dispenser. Furthermore, since the free ends 36 are located near or adjacent to the dispensing opening 32, the distance the sheet material must travel to be exposed out of the dispensing opening 32 is reduced for the orientation of the stack 7 shown in FIG. 1. As such, more reliable dispensing is achieved and the overlap length O can be readily adjusted for different sheet materials to obtain reliable dispensing.

Figure 3:
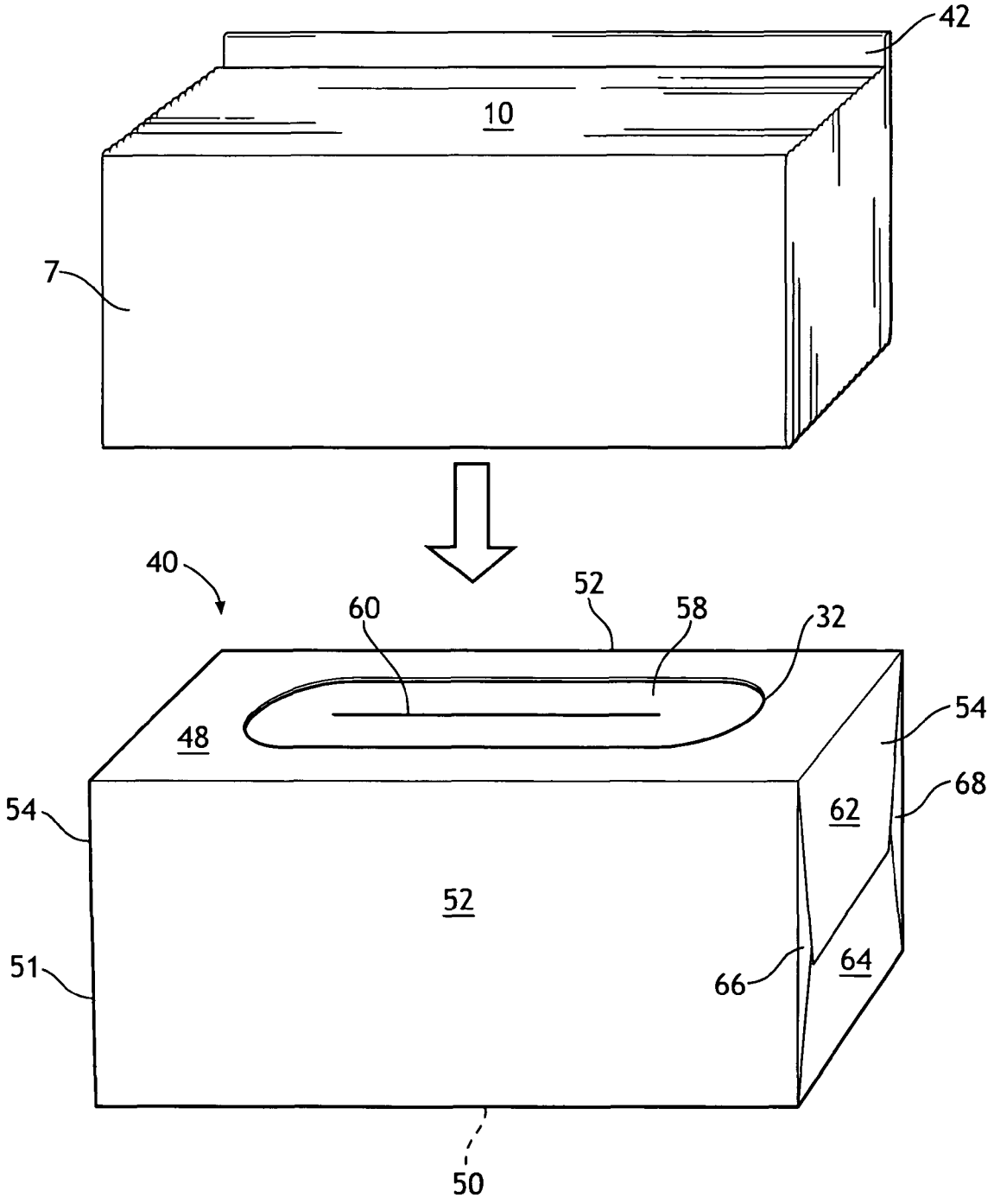
FIG. 3 illustrates the stack of FIG. 1 or 2 disposed in one embodiment of a dispenser.
Figure 4:
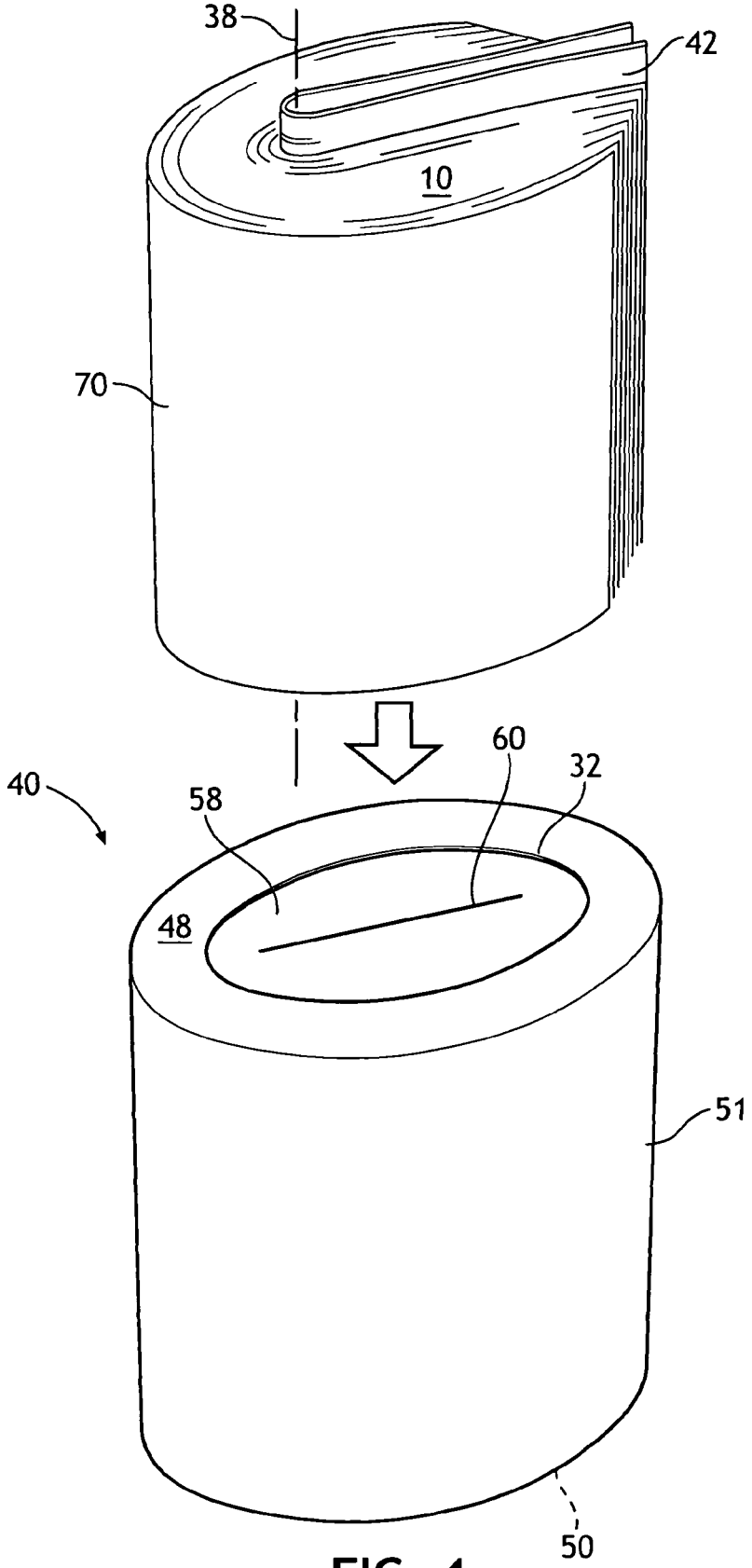
FIG. 4 illustrates the stack of FIG. 1 or 2 disposed in another embodiment of a dispenser.

The improved dispensing occurs whether the interfolded stack 7 is placed directly into a dispenser 40, as shown in FIG. 3, or whether the interfolded stack 7 is first folded about a transverse fold axis 38 and then placed into a dispenser, as shown in FIG. 4. Furthermore, unlike the interfolded stacks discussed in the '482 patent, each successive sheet can be dispensed with approximately the same amount of exposed sheet material 8 projecting from the dispensing opening 32. This eliminates the problem of one sheet being dispensed with minimal pop-up and the next sheet being dispensed with too much pop-up (loosely held) or even free supported (multiple dispensing).

Figure 2A:
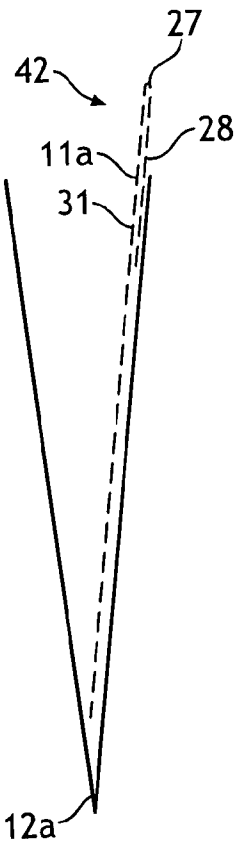
FIG. 2A illustrates another embodiment of a starter sheet for a stack of interfolded sheet material.
Figure 2:
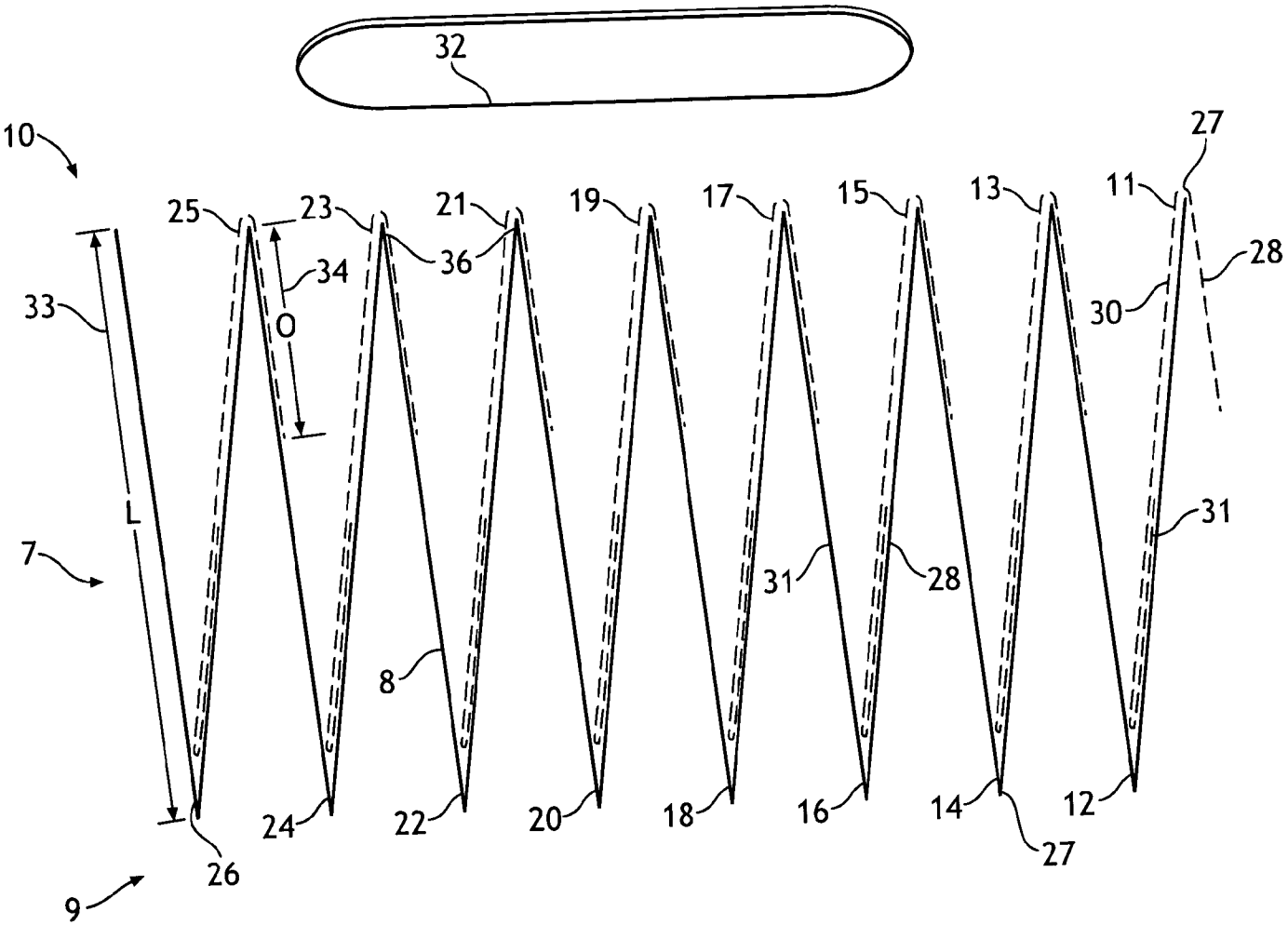
FIG. 2 illustrates another embodiment of a stack of interfolded sheet material.

Referring now to FIG. 2, an interfolded stack 7 of sheet material 8 having a plurality of individual interfolded sheets (11-26) is illustrated. The interfolded stack 7 has a first, or bottom, side 9 and a second, or top, side 10. The majority of the first side, even numbered sheets 12-26 (bottom-hand sheets), are folded into a first fold configuration, and the majority of the second side, odd number sheets 11-25 (top-hand), are folded into a second fold configuration. In the illustrated embodiment, the bottom-hand sheets are folded into a V-fold and interfolded with the top-hand sheets folded into a C-fold.

If desired, the top-hand sheets could be V-folded and interfolded with the bottom-hand sheets that are C-folded, depending on the dispenser opening configuration. For the purposes of this invention, a bottom-hand sheet, or a first side folded sheet, is a sheet that has a visible fold 27 when viewing the stack from the first, or bottom, side 9. A top-hand sheet, or second side folded sheet, is a sheet that has a visible fold 27 when viewing the stack from the second, or top, side 10.

While it is not required that all of the bottom-hand or all of the top-hand sheets be folded exactly the same, at least the majority (greater than ½ of the sheets for each hand) of the bottom-hand and of the top-hand sheets should be folded the same way. Additionally, the majority of the bottom-hand sheets should be folded in a different manner than the majority of the top-hand sheets. For example, the bottom-hand sheets can be V-folded and the top-hand sheets Z-folded. Or, the bottom-hand sheets could be V-folded and the top-hand sheets C-folded. Thus, while the individual sheets or even significant portions of the stack 7 may be folded differently for improved dispensing of the initial sheets, or to create a starter sheet(s), or for another purpose, the majority of the sheets in the stack are folded in two different folded configurations, depending on which side of the stack the folded sheet is located.

In various embodiments of the invention, greater than about 70 percent of the bottom-hand sheets are folded into a first fold configuration and greater than about 70 percent of the top-hand sheets are folded into a second fold configuration, or greater than about 80 percent of the bottom-hand sheets are folded into a first fold configuration and greater than about 80 percent of the top-hand sheets are folded into a second fold configuration, or greater than about 90 percent of the bottom-hand sheets are folded into a first fold configuration and greater than about 90 percent of the top-hand sheets are folded into a second fold configuration, or greater than about 95 percent of the bottom-hand sheets are folded into a first fold configuration and greater than about 95 percent of the top-hand sheets are folded into a second fold configuration. It is not necessary for the first and second configurations to be completely different fold types, only that the folded configurations are different.

The C-folded sheets have a leading panel 28, a center panel 30, and a trailing panel 31, each separated by a fold 27. A "leading panel" as used herein is the panel of the folded sheet that is first withdrawn through a dispensing opening 32 in a dispenser 40. All or a portion of the leading panel desirably remains partially exposed extending from the dispenser's opening upon withdrawal of a sheet from the dispenser. Similarly, the V-folded sheets have a leading panel 28 and a trailing panel 31.

The V-folded sheets and the C-folded sheets can have at least one folded panel length L (33) that is usually, but not necessarily, approximately ½ the length of the unfolded sheet. The V-folded sheets, however, do not need to be folded with a leading panel 28 and a trailing panel 31 having approximately the same length. Similarly, the C-folded sheets do not need to be folded with a leading panel 28 and a trailing panel 31 having approximately the same length. Desirably, the length of the C-folded center panel 30 is approximately equal to at least one of the panel lengths of the V-folded sheets (28, 31). However, if stack uniformity is less important, the center panel length 30 of the C-folded sheets can be different than either panel length of the V-folded sheets. In one embodiment, the majority of the C-folded sheets has a center panel (30) length that is approximately equal to the majority of both of the V-folded panel lengths (28, 31) and the majority of the C-folded sheet's leading and trailing panels (28, 31) lengths were approximately equal to ¼ the length of the unfolded sheet, as seen in FIG. 2.

The C-folded sheets have an overlap length O (34) representing the length that the leading panel 28 is in interleaved contact with a preceding V-folded sheet by being folded over the trailing panel 31 of that sheet. The overlap length O can be altered to change the pop-up dispensing characteristics of the stack 7. Smoother sheet materials having a lower coefficient of friction may require less overlap length O, while rougher or textured sheet materials having a higher coefficient of friction may require more overlap length O. By having less overlap length O a shorter length of the C-folded sheet projects from the dispensing opening, thereby leaving more of the sheet within the dispenser and in sheet-to-sheet frictional contact with the next V-folded sheet. This can help to better dispense the next sheet for smoother sheet materials. Similarly, by having a longer overlap length O, more of the C-folded sheet will project from the dispensing opening after withdrawing a V-folded sheet, leaving less of the C-folded sheet within the dispenser and in sheet-to-sheet frictional contact with the next V-folded sheet. This can be useful when dispensing sheet materials having a higher coefficient of friction.

The overlap length O can be altered as a function of the position of the individual sheet within the stack. Thus, sheets located at a greater distance from the dispensing opening may require a longer overlap distance O to pop-up reliably into the dispensing opening. This can be especially useful if the stack 7 is rotated 90 degrees and placed into-a dispenser with the center panel 30 of the C-folded sheets parallel to the dispenser's top panel having a dispensing opening.

Thus, depending on the overlap length O selected, the C-folded sheets may not be folded perfectly symmetrical with a leading panel 28 and a trailing panel 31 having the same length. One panel may be longer, such as the leading panel 28 having the overlap length O folded around the trailing panel 31 of the preceding V-folded sheet. Alternatively, for low coefficient of friction sheet materials, the leading panel 28 may be shorter than the trailing panel 31 to leave less sheet material extending from the dispensing opening, thereby increasing sheet-to-sheet frictional contact. In various embodiments of the invention, an Overlap Ratio representing the overlap length O (34) divided by the panel length L (33) of the preceding sheet can be between about 0.2 to about 0.8, or between about 0.3 to about 0.7, or between about 0.3 to about 0.6. In the embodiment, the Overlap Ratio is approximately 0.5.

The interfolded stack 7 of the present invention has an improved dispensing function over the interfolded stacks illustrated and described in U.S. Pat. No. 2,611,482. In particular, if the interfolded stack 7 is disposed into a dispenser 40 such that the dispensing opening 32 is located opposite the folds 27 in the V-folded sheets (12-26), significantly improved dispensing is obtained. Intermediate withdrawals of relatively loose or freely supported sheets can be avoided and the amount of sheet material extending from the dispensing opening can be approximately equal for each successive sheet withdrawn.

While not wishing to be bound by theory, the improved dispensing is believed to result from the two alternating folded configurations of the sheets within the stack 7 and from the orientation of the stack within the dispenser 40. If desired, the leading panel 28 of first sheet 11 can be unfolded and positioned to extend from the stack 7 to create a starter sheet 42, as shown in FIG. 3. With the C-folded sheet 11 partially extended through the dispenser's opening 32, a portion of center panel 30 is adjacent to the leading panel 28 of the next V-folded sheet 12 and the trailing panel 31 is adjacent the leading panel 28 of sheet 12. This reduces the sheet-to-sheet contact area as compared to the embodiment of FIG. 1 and may be more desirable for high coefficient of friction sheet materials. As the overlap length O is further increased even less contact area remains to the next V-folded sheet. As the C-folded sheet is dispensed by pulling on the leading panel 28, its center panel 30 tends to curl as it is withdrawn out of the smaller dispensing opening 32. This action curls the leading panel 28 of the V-folded sheet 12, which pulls the leading panel of the V-folded sheet through the dispensing opening 32. As more and more of the C-folded sheet 11 is pulled out of the opening, the contact surface area between the sheets decreases and the V-folded sheet 12 stops movement out of the dispensing opening, leaving the leading panel 28 partially exposed from the dispenser's opening.

When V-folded sheet 12 is next dispensed by pulling on the exposed leading panel 28, the trailing panel 31 unfolds the next leading panel 28 of the C-folded sheet 13, leaving it exposed from the dispensing opening. Since the overlap length O is fairly short, there is little additional movement of the C-folded sheet 13 out of the dispenser's opening due to sheet-to-sheet friction. However, if sheet 13 were a V-folded sheet having two equal panel lengths instead of the illustrated C-folded sheet, the amount of sheet material extending from the dispensing opening would likely be too great. This occurs since the length of approximately one panel L would be exposed and unfolded due to the large overlap length, plus any additional sheet-to-sheet friction would likely expose even more of the sheet. This can cause more of the sheet's length being exposed from the dispenser than being retained inside. In such circumstances, you end up with a free or loosely supported sheet in the dispensing opening.

The current invention solves this problem since, with the next sheet being C-folded, the amount of sheet material 8 extending from the dispensing opening is reduced to approximately the overlap length O. However, if the entire stack 7 were uniformly C-folded throughout (same overlap length O) and interleaved, it is likely that every other sheet would not pop-up when dispensed from the second side 10 of the stack rather than one of the ends, as more commonly done, since there may be an insufficient overlap length O for the bottom-hand C-folded sheets. Thus, alternating V and C folds leverages the overlap length O and sheet-to-sheet contact needed to ensure reliable dispensing for each sheet hand while dispensing from the side of the stack rather than the end.

The overlap length and/or fold configuration can be readily adjusted to take into account the friction characteristics of the sheet material, the dispenser's design, and the dispensing opening's geometry and orientation to provide reliable dispensing. Furthermore, since the free ends 36 of each V-folded sheet are located approximately the same distance from the dispensing opening 32 regardless of the sheet's position within the stack, reliable dispensing from the first sheet to the last can be easily obtained with the same overlap distance O. Should an individual sheet fail to pop-up, most likely a V-folded sheet will not partially withdraw when pulling on a preceding C-folded sheet, but the next V-folded sheet can be easily restarted since the free ends 36 of the sheet are located near the dispensing opening 32 and do not fall all the way down to the bottom of the container. Furthermore, since the free ends 36 are located near or adjacent to the dispensing opening 32, the distance the sheet material must travel to be exposed out of the dispensing opening 32 is reduced for the orientation of the stack shown in FIG. 2. As such, more reliable dispensing is achieved and the overlap length O can be readily adjusted for different sheet materials.

The improved dispensing occurs whether the interfolded stack 7 is placed directly into a dispenser 40, as shown in FIG. 3, or whether the interfolded stack 7 is first folded about a transverse fold axis 38 and then placed into a dispenser, as shown in FIG. 4. Furthermore, unlike the interfolded stacks discussed in the '482 patent, each successive sheet can be dispensed with approximately the same amount of exposed sheet material 8 projecting from the dispensing opening 32. This eliminates the problem of one sheet being dispensed with, minimal pop-up and the next sheet being dispensed with too much pop-up or even freely supported (multiple dispensing).

Referring now to FIG. 3, the interfolded stack 7 of FIG. 1 or 2 is shown with one possible orientation within the dispenser 40. While the stack 7 can be dispensed from the top side 10, bottom side 9, right or left ends of the stack, a preferred dispensing orientation is to locate the second side or top side 10 of the stack adjacent to the dispensing opening 32 as discussed above.

In various embodiments of the invention, the first sheet(s) of the stack 7 can be folded into a different configuration to serve as a starter sheet 42. The starter sheet can be formed by extending the leading panel 28 of the first sheet 11 from the top of the stack as previously discussed. Alternatively, sheets 11 and 12 can be folded differently and extended as shown in FIG. 1 to form two starter sheets 42 that are removed together by pinching and pulling on the exposed fold 27 of sheet 11, thereby trapping the leading panel 28 of sheet 12 and removing both together. This can be done by folding sheet 12 with a longer leading panel 28 and then interleaving either a Z- or C-folded sheet about the longer panel. The length of leading panel 28 of sheet 12 can be controlled to vary how high the starter sheet(s) extend past the top of the stack 7. By having a folded edge and/or two or more sheets to grab instead of a single ply, improved starter sheet reliability can be achieved, especially when the stack is placed into a dispenser that may initially compress the stack until some of the sheet material is dispensed. Pulling on more layers or plies can reduce sheet tears for the first sheet dispensed.

Alternatively, referring to FIG. 2A, the starter sheet can be formed by folding the first sheet 11*a* of the stack into a J-shape having a leading panel 28 that is shorter than the trailing panel 31. The sheet is interleaved with the next sheet 12*a* such that the folded edge 27 projects from the top of the stack 7. Additional starter sheets and apparatus to fold them are disclosed in U.S. Pat. No. 6,238,328, entitled Folding Device that issued May 29, 2001, to Loppnow et al., and in U.S. Pat. No. 6,685,050, entitled Folded Sheet Product, Dispenser, and Related Assembly that issued Feb. 3, 2004, to Schmidt et al. Other methods can be used to create a starter sheet, such as using a different colored sheet or attaching a pull strip to the first sheet.

The dispenser includes a top 48, a bottom 50, and a sidewall 51 formed from two pairs of opposing sidewalls 52 and 54 that intersect at approximately 90 degree angles. The top 48 includes a dispensing opening 32 that can be any size or shape such as square, rectangular, circular, triangular or oval. In an alternative embodiment, the dispensing opening 32 has a portion that resides in the top and another portion that resides in the sidewall 51.

The dispensing opening can include a dispensing window 58 made from a suitable material such as a film, nonwoven, or paper material that can retain a partially dispensed sheet within the dispensing opening for pop-up dispensing. The dispensing window 58 can include a dispensing orifice 60 that can be a slit; a curvilinear line; a geometric shape such as an oval, a circle, or a triangle; or an X-shaped, +-shaped or H-shaped slit or slot. Alternatively, the dispensing window 58 can be eliminated and fingers or tabs projecting into the dispensing opening 32 can be used to retain the partially dispensed sheet.

For ease of loading the stack 7 into the dispenser 40 using automated packaging equipment, generally the first pair of opposing sidewalls 52 are unitary and the second pair of opposing sidewalls 54 are formed from a plurality of flaps. The second pair of opposing sidewalls 54 can include an upper major flap 62, a lower major flap 64, a left minor flap 66, and a right minor flap 68. The flaps can be folded such that they overlap and then are glued together to form the second pair of opposing sidewalls 54 after filling the dispenser 40 with the stack 7, having the second side 10 adjacent to the dispensing opening 32.

Referring now to FIG. 4, the interfolded stack 7 of FIG. 1 or 2 is shown with one possible orientation within the dispenser 40. While the stack 7 can be dispensed from the top, bottom, right or left sides of the stack, a preferred dispensing orientation is to locate the second side or right side 10 adjacent to the dispensing opening as discussed above. In this embodiment, the stack is folded about a transverse fold axis 38 into a U-Shape (centrally located fold axis) or a J-shape (offset fold axis). As shown, the folded stack 70 has a starter sheet 42 for ease in locating the initial sheet to dispense.

The dispenser includes a top 48, a bottom 50, and a sidewall 51. The sidewall can be curvilinear having an oval profile, a circular profile, an elliptical profile, or a racetrack profile with curved ends and a flat front panel or back panel or both front and back panels flat. Because the folded stack 70 tends to assume an oval or circular shape, as shown in FIG. 4, placement of the folded stack into a dispenser 40 with a curvilinear sidewall 51 allows for much less wasted space within the dispenser and for an improved dispensing function. The folded stack 70 is no longer compressed as much, if at all, by the sidewall 51, unlike in a standard upright tissue dispenser. A common problem with standard upright tissue dispensers is that the U-shaped folded stack 70, when oriented vertically within the upright dispenser, is pinched between the dispenser's sidewalls. This leads to dispensing problems (sheet tears for the initial sheets) and wastes interior space within the dispenser as discussed further in U.S. patent application Ser. No. 10/955,435, entitled Folded Clip and Dispenser, filed on Sep. 30, 2004, to Long et al. Because the dispenser 40 and the folded stack 70 are similarly shaped, the folded stack fits into the dispenser 40 with a curvilinear sidewall 51, like a hand into a glove.

The top 48 includes a dispensing opening 32 that can be any size or shape, such as square, rectangular, circular, triangular or oval. In an alternative embodiment, the dispensing opening 32 has a portion that resides in the top and another portion that resides in the sidewall 51.

The dispensing opening can include a dispensing window 58 made from a suitable material, such as a film, nonwoven, or paper material that can retain a partially dispensed sheet within the dispensing opening for pop-up dispensing. The dispensing window 58 can include a dispensing orifice 60 that can be a slit; a curvilinear line; a geometric shape such as an oval, a circle, or a triangle; or an X-shaped, +-shaped or H-shaped slit or slot. Alternatively, the dispensing window 58 can be eliminated and fingers or tabs projecting into the dispensing opening 32 can be used to retain the partially dispensed sheet.

For ease of loading the folded stack 70 into the dispenser 40 using automated packaging equipment, the dispenser may have a preformed bottom or top and then a cap may be inserted into or over the open end after placing the folded stack into the dispenser to close the dispenser. Suitable caps are disclosed in U.S. patent application Ser. No. 11/021,317, entitled Container Caps and Container, filed on Dec. 22, 2004, to McDonald. Alternatively, the dispenser's sidewall may be formed and a cap inserted into or over both the top and bottom to form the dispenser.

While the above invention has been discussed using a combination of V and Z folds or V and C folds, the invention is not limited to these types of folds. The first fold configuration could be any known sheet fold and the second fold configuration a different known sheet fold. In particular, the stack 7 can comprise a first fold configuration for the bottom-hand sheets having an even number of equally sized panels and a second fold configuration for the top-hand sheets having an odd number of folded panels with the first and last panels being smaller and having a length added together equal to the length of one of the central panels.

In various embodiments of the invention, the stack 7 can contain between about 10 to about 500 sheets, or between about 50 to about 300 sheets, or between about 60 to about 150 sheets. In one embodiment, the stack comprises interfolded two- or three-ply facial tissue sheets containing between about 60 to about 135 individual facial tissue sheets.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

I claim:

1. A product comprising:

a stack of a plurality of interfolded sheets assembled from a folded sheet material;

the stack having a first side, a second side, a plurality of first side folded sheets and a plurality of second side folded sheets;

a majority of the first side folded sheets folded into a "V-fold" configuration; and a majority of the second side folded sheets folded into a "Z-fold" configuration.

2. A product comprising:

a stack of a plurality of interfolded sheets assembled from a folded sheet material;

the stack having a first side, a second side, a plurality of first side folded sheets and a plurality of second side folded sheets;

a majority of the first side folded sheets folded into a "V-fold" configuration; and a majority of the second side folded sheets folded into a C-fold configuration.

3. The product of claim 1 wherein greater than about 70 percent of the first side sheets are folded into the "V-fold" configuration and greater than about 70 percent of the second side sheets are folded into the "Z-fold" configuration.

4. The product of claim 1 or 2 wherein the stack of interfolded sheets has an overlap length O, a panel length L, and an Overlap Ratio of O/L, and wherein the Overlap Ratio is between about 0.2 to about 0.8.

5. The product of claim 1 or 2 wherein the stack of interfolded sheets has an overlap length O, a panel length L, and an Overlap Ratio of O/L, and wherein the Overlap Ratio is between about 0.3 to about 0.7.

6. The product of claim 1 or 2 wherein the stack of interfolded sheets has an overlap length O, a panel length L, and an Overlap Ratio of O/L, and wherein the Overlap Ratio is between about 0.3 to about 0.6.

7. The product of claim 1 or 2 wherein the stack comprises a starter sheet that extends from the second side of the stack.

8. The product of claim 1 or 2 comprising a dispenser having a top, a bottom, a sidewall, a dispensing opening in the top, and the stack is positioned within the dispenser.

9. The product of claim 8 wherein the first side of the stack is positioned adjacent to the bottom and the second side of the stack is positioned adjacent to the dispensing opening.

10. The product of claim 2 wherein greater than about 70 percent of the first side sheets are folded into the "V-fold" configuration and greater than about 70 percent of the second side sheets are folded into the C-fold configuration.

* * * * *